US006210015B1

(12) United States Patent
Ross

(10) Patent No.: US 6,210,015 B1
(45) Date of Patent: Apr. 3, 2001

(54) STAND FOR CAKES OR PASTRY

(76) Inventor: Kenneth Alan Ross, 10378 N. State Rd. 9, Fountaintown, IN (US) 46130

( * ) Notice: Subject to any disclaimer, the term of this patent is extended or adjusted under 35 U.S.C. 154(b) by 0 days.

(21) Appl. No.: 09/411,711

(22) Filed: Oct. 4, 1999

(51) Int. Cl.[7] ..... F21V 33/00

(52) U.S. Cl. ..... 362/101; 362/96; 362/562; 362/806; 362/318; 362/253; 119/266; 119/267

(58) Field of Search ..... 362/96, 101, 562, 362/806, 318, 253; 119/266, 267

(56) References Cited

U.S. PATENT DOCUMENTS 4,703,720 * 11/1987 Shipman ..... 119/5
5,189,982 * 3/1993 Liu ..... 119/5
5,967,639 * 10/1999 Shih ..... 362/101
6,065,850 * 5/2000 Chiu ..... 362/101

* cited by examiner

*Primary Examiner*—Sandra O'Shea
*Assistant Examiner*—Ali Alavi
(74) *Attorney, Agent, or Firm*—Jack Schuman

(57) ABSTRACT

A stand for cakes or pastries comprises a base, a transparent column mounted to said base, and a platform positioned on said transparent tube to support the cake or pastry. Air bubbles are introduced into water in the transparent tube, and an electric bulb in the base lights up the water and air bubbles.

6 Claims, 3 Drawing Sheets

STAND FOR CAKES OR PASTRY

BACKGROUND OF THE INVENTION

1. Field of the Invention

This invention relates to a novel stand for the decorative display of cakes or pastry at weddings, birthdays, anniversaries or other special events.

2. Description of the Prior Art

Supporting stands for cakes and pastry to be exhibited at special events are known.

No prior cake or pastry stands are known having the unique decorative features of the present stand, which features include a column of bubbles lit by light in a column of water or other liquid.

SUMMARY OF THE INVENTION

One of the objects of this invention is to provide a novel stand for the decorative display of cakes and similar items at weddings, birthdays, anniversaries and other special events.

Other and further objects of this invention will become apparent by reference to the accompanying specification and drawings and to the appended claims.

Briefly, I have discovered that the foregoing objects may be attained by providing a base supporting a hollow transparent tube which in turn supports a stand on which the cake or pastry is exhibited. Means are provided to generate a column of air bubbles in water or other colored liquid contained within the tube. Lighting means are provided to illuminate the inside of the tube and the water and column of air bubbles contained therein.

DESCRIPTION OF THE DRAWINGS

Referring now to the drawings, in which like numerals represent like parts in the several views.

DESCRIPTION OF THE PREFERRED EMBODIMENTS

The present invention is seen as comprising base 1, adapted to be stably supported on a table or the like (not shown), transparent water-tight tube 2 which may be of glass or clear plastic material made, for example, from an acrylic polymer, and platform 3 adapted to support a cake, pastry or the like (not shown) mounted on the upper end of tube 2. Sleeve 4, securely mounted to the bottom face of platform 3 adjacent the center thereof, slidably fits inside the upper end of tube 2, and is of length sufficient to stabilize platform 3 when a cake or pastry is placed thereon.

Figure 1:
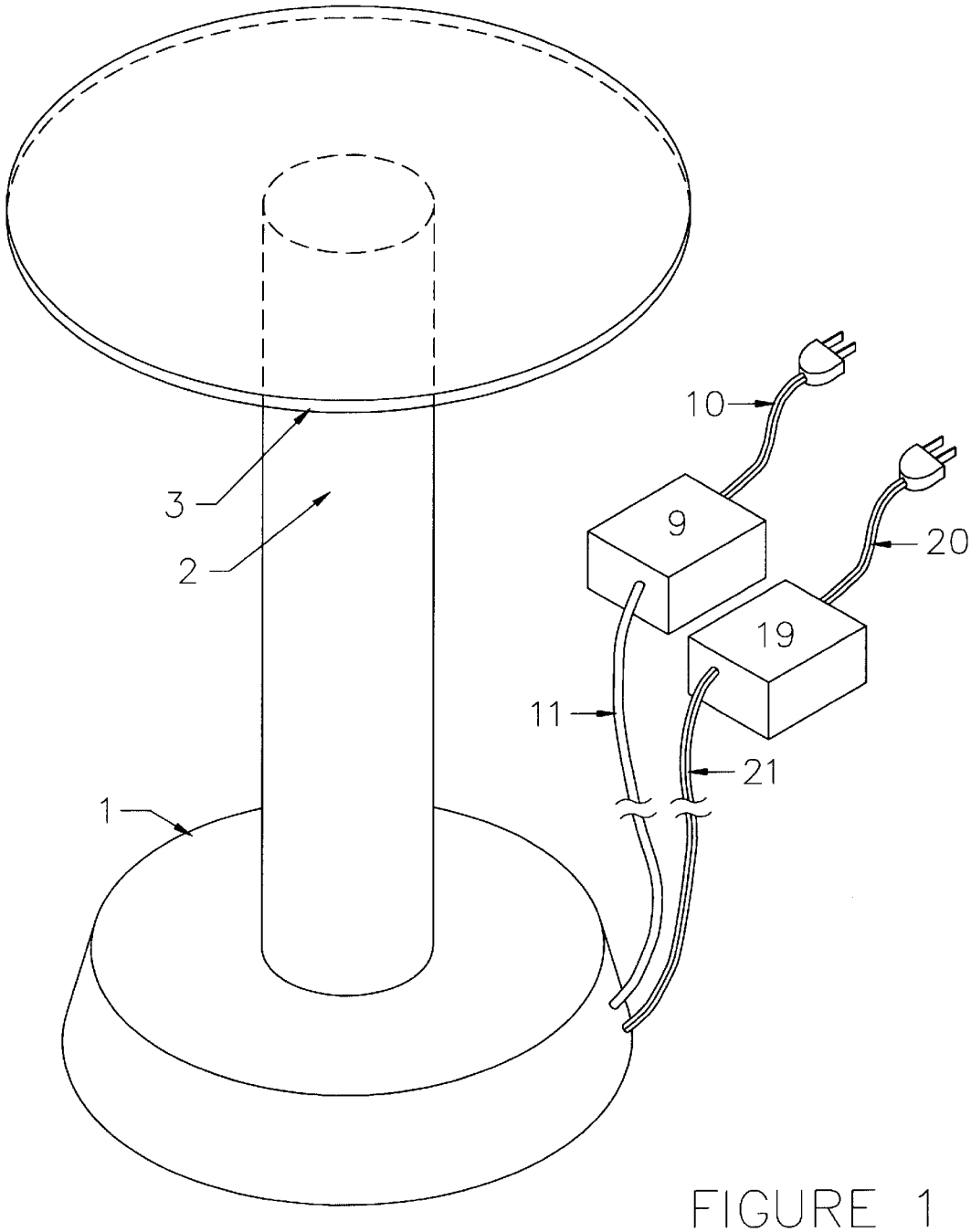
FIG. 1 represents a partially diagrammatic view in perspective of the present invention, showing the air pump and the power pack.
Figure 2:
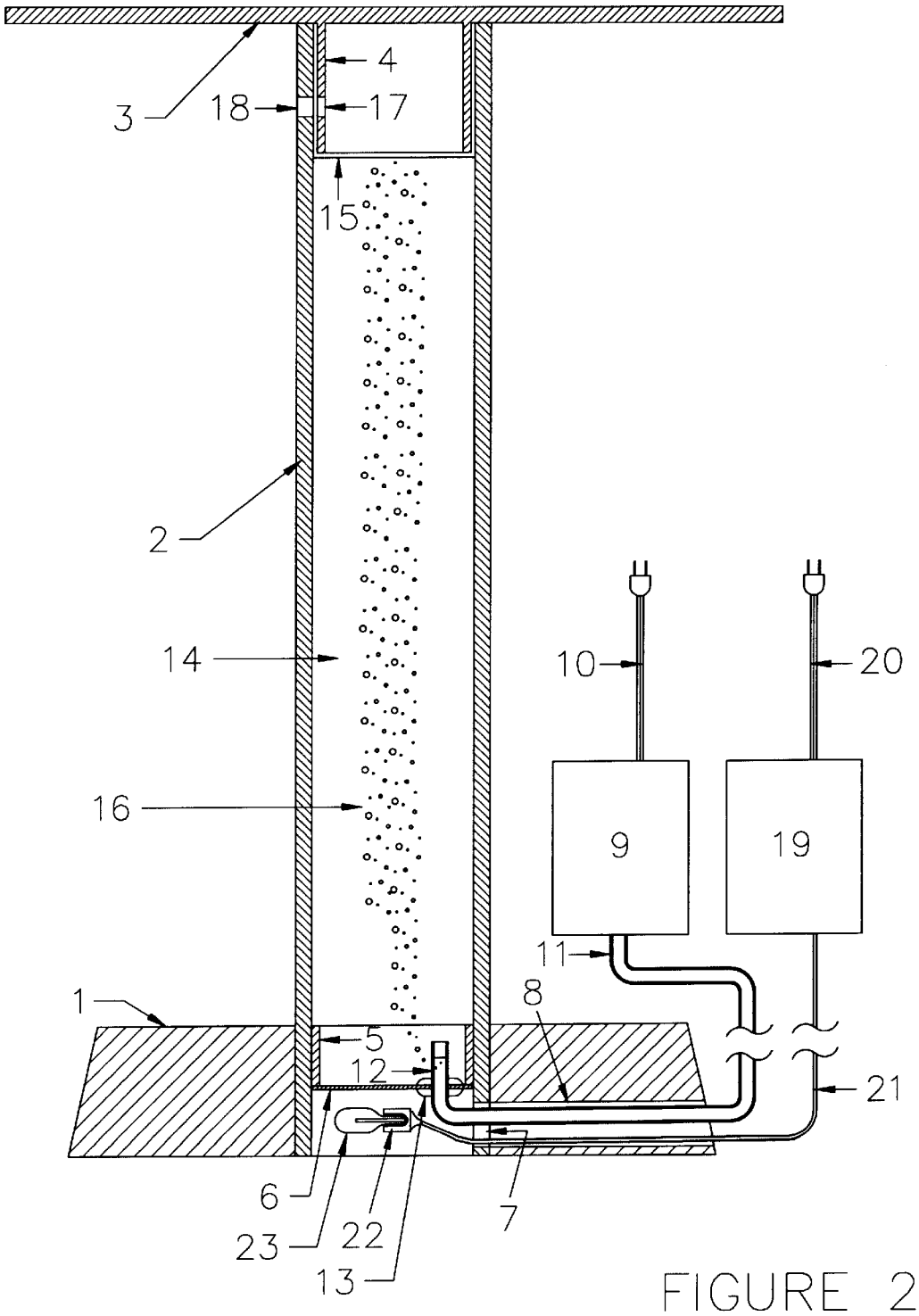
FIG. 2 represents a view in elevation, partially in section and partially diagrammatic, of one embodiment of the present invention.

In the embodiment of the invention shown in some detail in FIG. 2, the lower portion of tube 2 extends through an opening in base 1 to the bottom thereof, and may be secured therein by means of cement or glue or the like.

Inverted sleeve 5, water-tightly closed at the bottom thereof by means of transparent plate 6, which may be of glass or clear plastic material made, for example, from an acrylic polymer, is mounted within tube 2 adjacent the lower end thereof, and is secured therein by cement or glue or the like so as to provide a water-tight seal between the periphery of inverted sleeve 5 and the adjacent interior surface of tube 2

Tube 2 is provided at its lower end below plate 6 of inverted sleeve 5, with aperture 7 registering with aperture 8 in base 1.

Air pump 9, powered by line 10 connected to a household main (not shown), is provided with air hose 11 running through apertures 7 and 8 and connected to air nozzle 12. Grommet 13 mounted in an aperture in plate 6 provides a water-tight seal around air nozzle 12.

Platform 3, with sleeve 4 connected thereto, may temporarily be removed from tube 2, by lifting it until sleeve 4 slides out of and above the upper end of tube 2, so as to permit tube 2 to be filled with water or other colored liquid up to a level indicated diagrammatically by line 15, after which platform 3 and sleeve 4 are placed in their original positions. The water-tight seal around air nozzle 12 where it passes through plate 6, and the water-tight seal between inverted sleeve 5 and the interior of tube 2 effectively prevents any liquid in tube 2 from escaping below plate 6.

It will be seen that air pumped from air pump 9 passes through air hose 11 and air nozzle 12 into the column of water 14 in tube 2 as bubbles 16 which rise through the column of water 14 into sleeve 4, escaping from the apparatus through aperture 17 in sleeve 4 registering with aperture 18 in tube 2.

Power pack or step-down transformer 19, powered by line 20 connected to a household main (not shown), delivers through line 21, which runs through apertures 7 and 8, low voltage electricity through socket 22 to light bulb 23. Light from light bulb 23 passes through transparent plate 6 into the column of water 14 in tube 2.

The column of air bubbles 16 rising through the column of water 14 or other colored liquid, lit by light from light bulb 23 provides a most decorative effect to heighten the special occasion calling for the cake or pastry.

Figure 3:
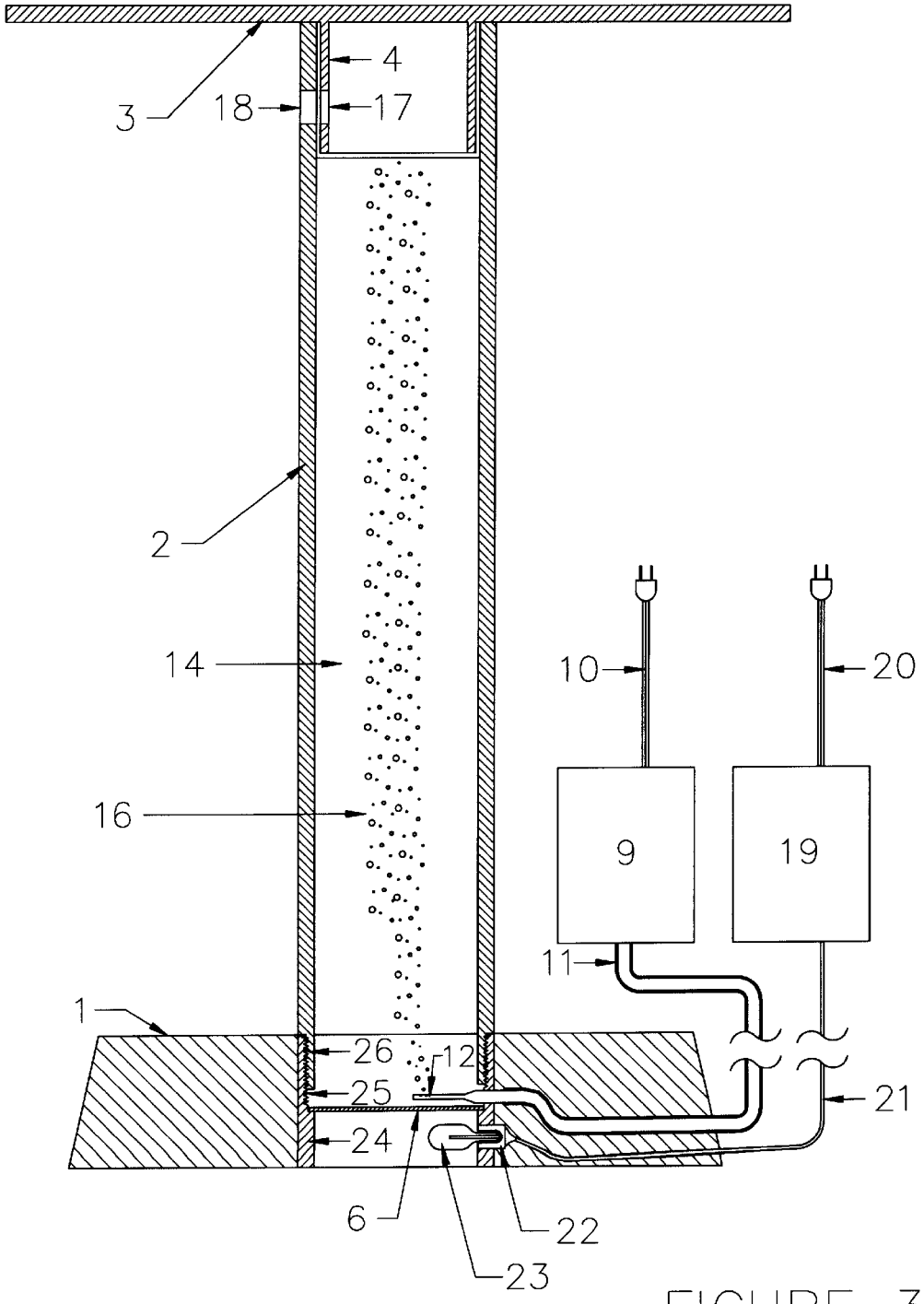
FIG. 3 represents a view in elevation, partially in section and partially diagrammatic, of another embodiment of the present invention.

In the embodiment of FIG. 3, tube 2 is threaded into base 1. This may, for example, be done by providing collar 24 with internal thread 25, and which is secured by cement or glue to the central aperture in base 1. The bottom of tube 2 is provided with male thread 26 which can be screwed into collar 24. Air hose 11 extends from air pump 9 through apertures (not shown) in base 1 and collar 24 to air nozzle 12 positioned above plate 6 in the water column 14. Plate 6 is secured in a water-tight manner to collar 24, so as to prevent the escape of water 14 from that portion of tube 2 above plate 6 to the space below plate 6. Power line 21 extends from power pack 19 through apertures (not shown) in base 1 and collar 24 to socket 22 holding bulb 23. In the same manner as with the embodiment of FIG. 2, the passage of air bubbles 16 through water column 14 and the light from bulb 23 provides a most decorative effect.

In the embodiments of FIGS. 2 and 3, the color of the light passing through water column 14 can be altered by placing colored glass or plastic beads, or colored glass or plastic filters, on plate 6.

To further heighten the decorative effect, small fish, like goldfish or tropical fish, can be placed in tube 2 in the water column 14.

The foregoing description is illustrative of the principles of my invention. Further, since numerous modifications and changes may readily occur to those skilled in the art to which this invention pertains, the invention should not be limited to the exact apparatus shown and described herein, and the appended claims should be construed as covering suitable modifications and equivalents.

I claim:

1. A stand for supporting a cake or pastry or the like, said stand comprising:

(a) a base having an upper surface, a lower surface, and a central opening extending from said upper surface to said lower surface, said base being supported on a table or the like, (b) a transparent tube having an upper end and a lower end, (c) the lower end of said tube being secured in said central opening of said base, (d) a platform having an upper face to support said cake or pastry and a lower face positioned on the upper end of said tube, (e) a sleeve secured to the central portion of the lower face of said platform and slidably engaging the periphery of said tube, (f) a transparent plate transversely mounted in said tube adjacent the lower end thereof and dividing said tube into:

(i) an upper column of height sufficient to extend from a plane adjacent the lower portion of said tube to the upper portion of said tube, (ii) a lower column extending to the lower portion of said tube below said transparent plate and of height substantially smaller than said upper column, (g) said plate providing a water-tight barrier between said upper column and said lower column, (h) an air pump, (i) an air nozzle adjacent said transparent plate and communicating with the upper column of said tube, (j) an air conduit extending between said air pump and said air nozzle to deliver air to said air nozzle, (k) a source of electric power, (l) an electric bulb mounted in the lower column of said tube below said transparent plate, (m) an electric conduit extending between said source of electric power and said electric bulb to light up said electric bulb, (n) an aperture extending through the upper column of said tube and communicating with the atmosphere, (o) a liquid in the upper column of said tube, (p) whereby air introduced into said liquid by said air nozzle bubbles upwardly through said liquid and exits to the atmosphere through said aperture in the upper column of said tube, (q) whereby light from said electric bulb is transmitted through said transparent plate into said liquid in the upper column of said tube, (r) whereby a novel decorative effect is achieved.

2. A stand as in claim 1, wherein:

(s) said sleeve slidably extends through the upper end of said tube into the interior thereof.

3. A stand as in claim 1, wherein:

(s) said transparent plate is tinted.

4. A stand as in claim 1, further comprising:

(s) colored glass or plastic beads placed on said transparent plate.

5. A stand as in claim 1, further comprising:

(s) a colored transparent filter placed on said transparent plate.

6. A stand as in claim 1, wherein:

(s) said air nozzle extends through said transparent plate from the lower column of said tube to to the upper column of said tube, further comprising:

(t) a watertight seal around said air nozzle where said air nozzle extends through said transparent plate.

* * * * *